US005731572A

United States Patent [19]

Winn

[11] Patent Number: 5,731,572

[45] Date of Patent: Mar. 24, 1998

[54] SIX SIGMA CALCULATOR

[75] Inventor: Kirk T. Winn, Redondo Beach, Calif.

[73] Assignee: Hughes Electronics, Los Angeles, Calif.

[21] Appl. No.: 754,376

[22] Filed: Nov. 21, 1996

[51] Int. Cl.[6] ..... G06G 1/02

[52] U.S. Cl. ..... 235/70 R

[58] Field of Search ..... 235/70 R, 70 A, 235/70 B, 70 C, 70 D, 85 R, 89 R, 88 N, 65

[56] References Cited

U.S. PATENT DOCUMENTS

| | | | |
|---|---|---|---|
| 3,736,833 | 6/1973 | Alvardo | 84/473 |
| 3,747,847 | 7/1973 | Cohen | 235/85 R |
| 4,564,750 | 1/1986 | Olsen | 235/89 R |
| 5,137,302 | 8/1992 | Angel | 283/65 |
| 5,449,890 | 9/1995 | van Neck | 235/70 R |
| 5,458,376 | 10/1995 | Biewald | 283/65 |
| 5,458,377 | 10/1995 | Utz et al. | 283/65 |

OTHER PUBLICATIONS

Six Sigma Productibility Analysis and Process Characterization Hany et al, 1992, pp. 1–1 to 1–5, 2–4–2 and 5–11 to 5–13.

*Primary Examiner*—Adolf Berhane

*Attorney, Agent, or Firm*—Gordon R. Lindeen, III; Michael W. Sales; Wanda K. Denson-Low

[57] ABSTRACT

A slide rule permits rapid calculations of parameters used in the Six Sigma quality analysis program. For a given number of defects per product and a known number of parts per product (opportunities), the device permits rapid calculation of the number of defects per million opportunities as well as various statistical relationships, with a single movement of the slide.

19 Claims, 2 Drawing Sheets

SIX SIGMA CALCULATOR

BACKGROUND OF THE INVENTION

1. Field of the Invention

This invention relates to a slide rule that implements formulas associated with the Six Sigma quality analysis program.

2. Description of the Related Art

With the advent of the worldwide marketplace and the corresponding consumer demand for highly reliable products, quality has become an increasingly important issue for manufacturers. When manufactured products having defects are produced and sold, the result is lost manufacturing time as well as unfavorable publicity for the manufacturer. The quality of a company's product line can therefore play a decisive role in determining the company's reputation. As a result of this pressure for defect-free products, increased emphasis is being placed on quality control at all levels; it is no longer just an issue with which quality control managers are concerned. This has led to various initiatives designed to improve quality, such as the Total Quality Management (TQM) and the Six Sigma quality analysis programs. An overview of the Six Sigma program is presented by Mikel J. Harry and J. Ronald Lawson in "Six Sigma Producibility Analysis and Process Characterization," Addison Wesley Publishing Co., pp. 1–1 through 1–5, 1992.

The goal of the Six Sigma program is to significantly reduce the number of defects within products, particularly when those products involve a large number of components. To this end, the Six Sigma program makes use of various statistical tests that workers and managers use to measure the quality of products, both in development and in production. Some of these tests involve specific terminology. An "opportunity" is anything that must be correct to produce a defect-free product or service, or alternatively, anything that might go wrong and keep the product from working. For example, opportunities could be steps in a manufacturing process, or parts and leads on a circuit card assembly. The total number of all the opportunities in a given product is known as that product's "opportunity count" (OpCount). A "defect" refers to any variation in a characteristic of a product (e.g. its length, width, weight, etc.) that is far enough removed from its target value to keep the product from functioning properly. "Defects per unit" (DPU) is the average number of defects per unit (i.e. defects per product). This rate is often normalized to one million opportunities and referred to as "the number of defects per million opportunities" (DPMO). In general, DPMO is given by $$DPMO=(DPU\times 10^6)/OpCount \tag{1}$$

The "First Time Yield (FTY)" is the percentage of units that are completely defect-free. As discussed on pp. 2–4 through 2–8 of the Harry and Lawson reference, the FTY can generally be approximated by the well known Poisson relation:

$$FTY=e^{-DPU} \tag{2}$$

The "Sigma Rating" and "$C_{pk}$" are also measures of how defect-free a product is and are based on Gaussian statistics, as explained below. Production quality can be tracked by plotting in histogram form a parameter that measures a specific characteristic of the product being manufactured (e.g. its length) against frequency of production. FIG. 1 shows such a histogram that comprises various bars 10, in which the height of a bar represents the number of products falling within a certain range of the parameter. The bars 10 tend to congregate around a center bar 10', which is ideally near the optimum design point for the parameter under consideration. According to the well-known Central Limit Theorem, a histogram of a large sample will tend towards a Gaussian distribution 14, regardless of whether, say, Poisson or binomial distributions for the parameter being considered are assumed. This Gaussian distribution function 14 is given by $$f(x)=\frac{1}{\sigma\sqrt{2\pi}}\,e^{-\frac{[(x-\mu)/\sigma]^2}{2}} \tag{3}$$

for $-\infty<x<\infty$, in which the statistical mean is given by $\mu$, and $\sigma$ is the standard deviation. Approximately 68% of the area of function 14 lies within one standard deviation ($1\sigma$) of the mean $\mu$, 95% within $2\sigma$ of it, and 99.9999998% within $6\sigma$ of $\mu$.

Over time, however, the mean $\mu$ may shift away from the optimum design point and tend towards a new mean $\mu'$. This may be due to degradation of tools used in manufacturing the product, for example. This is accounted for within the Six Sigma formalism in an ad hoc way by assuming an additional shift to the mean of 1.5 $\sigma$ to give a modified Gaussian distribution 16, as shown in FIG. 2, in which the Gaussian distribution 14 has also been replotted. The fraction of the modified Gaussian distribution 16 (in which $\mu'=\mu+1.5\sigma$) that lies beyond the $6\sigma$ point of the unmodified Gaussian distribution 14 corresponds to 3.4 parts per million (ppm), which is typically the DPMO goal of the Six Sigma program. Thus, a DPMO of 3.4 ppm is said to be equivalent to a Sigma Rating of 6. In general, the Sigma Rating can be determined by calculating the DPMO, correlating this value with the equivalent area underneath the modified Gaussian distribution 16 between $+\infty$ and some lower limit closer to $\mu'$, and determining how many standard deviations from the unmodified mean $\mu$ this lower limit is displaced. Thus, a higher DPMO corresponds to a smaller Sigma Rating and vice versa. The Sigma Rating can also be expressed by $C_{pk}$, which is discussed on pp. 5–11 through 5–13 of the Harry and Lawson reference. For the case at hand, it can be expressed as:

$$C_{pk}=(\text{Sigma Rating}-1.5)/3 \tag{4}$$

Thus, the parameters DPMO, the Sigma Rating and $C_{pk}$ are alternative expressions of the frequency of defects with respect to the total number of opportunities.

To calculate these parameters can be cumbersome, even if a hand-held calculator is used. To avoid the inconvenience of using calculators, look-up tables are often used instead, in which the various parameters of interest are listed in columns and correlated with each other. Nevertheless, these tables do not provide the user with enough flexibility, e.g. it is generally necessary to interpolate between the listed values. Furthermore, the user is not presented information in a way that is interactive, so that a "feel" for the numbers and the relationship of the various quantities to each other is lost.

Existing slide rules, even those concerned with statistical processes, do not address the concerns of the Six Sigma user adequately. For example, the "SPC Tutor" by Dimensional Data Systems, 1990, is designed to look at various process capabilities, including $C_{pk}$, but these are not correlated with other parameters of importance to the Six Sigma user such as DPU, FTY, OpCount, DPMO and the Sigma Rating. Thus, this particular slide rule is of no benefit to the Six Sigma user.

SUMMARY OF THE INVENTION

The present invention is for a slide rule that calculates various parameters associated with the Six Sigma quality analysis program with a single movement of the slide. The user saves time by avoiding the tediousness associated with spreadsheet and electronic calculations. The slide rule gives the user the flexibility to make calculations rapidly and correlate the various parameters discussed herein with each other simultaneously, permitting him to quickly analyze the performance of processes and parts in a product.

The invention includes a sliding scale display section that is preferably a sliding sheet which has scales printed on it for quantities such as DPMO, Sigma Rating, $C_{pk}$ and OpCount. The sliding sheet slips into a stationary scale display section that preferably includes scales for DPU and FTY located on opposite sides of a window that mates with the OpCount scale. The stationary section also includes windows that permit the other scales of the sliding sheet to be viewed. By aligning the OpCount scale with either the DPU scale or the FTY scale, the user can calculate the corresponding DPMO, Sigma Rating, and $C_{pk}$ values. The DPU, OpCount and DPMO scales are preferably logarithmic.

Further features and advantages of the invention will be apparent to those skilled in the art from the following detailed description, taken together with the accompanying drawings.

DETAILED DESCRIPTION OF THE INVENTION

The invention functions like a slide rule and allows the user to correlate, with a single movement of the slide, various parameters that are commonly used in the Six Sigma quality analysis program, such as DPU, OpCount, FTY, DPMO, Sigma Rating and $C_{pk}$. It comprises scales for preferably each of these quantities, some of which are slidable, so that, for example, values of OpCount and DPU can be selected to generate related statistical quantities such as DPMO, Sigma Rating and $C_{pk}$.

Figure 1:
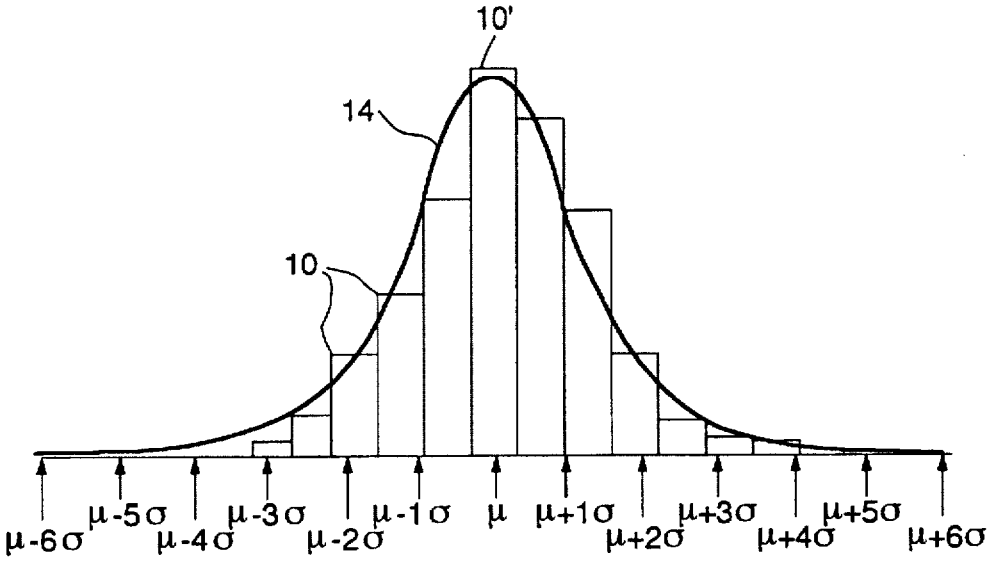
FIG. 1 ( PRIOR ART )
FIG. 1 is a histogram illustrating how a large sample of products tends towards a Gaussian distribution with respect to a manufacturing parameter.
Figure 2:
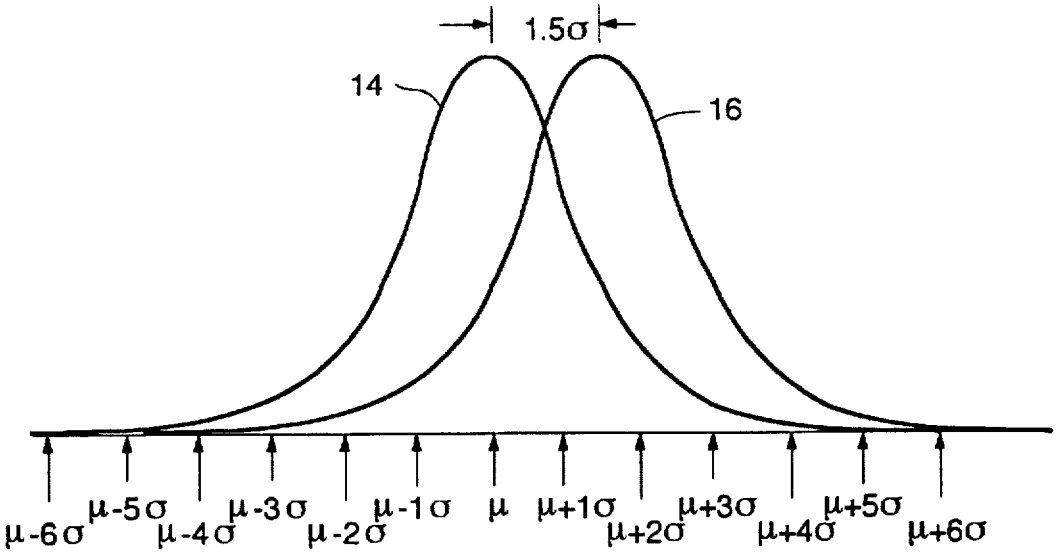
FIG. 2 ( PRIOR ART )
FIG. 2 is a graph showing a typical Gaussian distribution and a mean shifted Gaussian that characterizes Six Sigma analysis.
Figure 3:
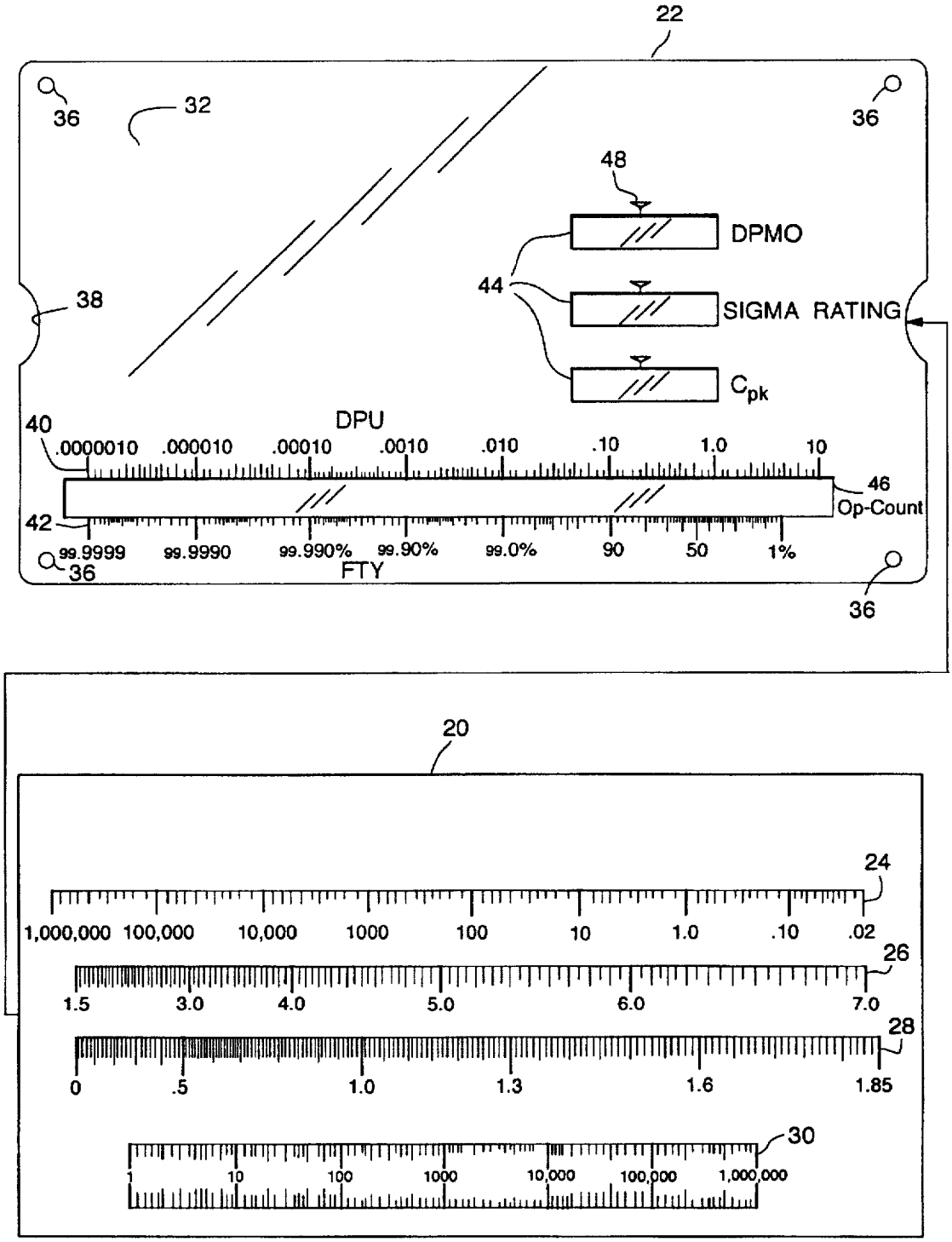
FIG. 3 is an elevation view illustrating a preferred embodiment of the invention.

The preferred embodiment is shown in FIG. 3 (drawn roughly to scale), and includes a sliding scale display section that is preferably a sliding sheet 20 which slides in and out of a stationary scale display section that is preferably a stationary pocket section 22, both of whose ends are open. The sliding sheet 20 is preferably made of rigid paper stock or plastic and preferably has four scales printed on it: a DPMO scale 24, a Sigma Rating scale 26, a $C_{pk}$ scale 28 and an OpCount scale 30. Thus, scales 24, 26, 28 and 30 slide in and out of the stationary pocket section 22 with their sliding sheet 20. All of the scales disclosed herein preferably include a series of marks that are periodically designated with numbers to indicate their values. The stationary pocket section 22 preferably comprises a facesheet 32 and a rear sheet (not shown), both of rigid paper stock or plastic and secured together with metal fasteners 36, so that the sliding sheet 20 is housed securely in the stationary pocket section.

Thumb notches 38 are cut into one or both ends of the facesheet 32 as well as the rear sheet of the stationary pocket section 22 to allow the user to more easily grasp the sliding sheet 20 after it has been inserted into the stationary pocket section.

The facesheet 32 preferably has two scales printed on it, a DPU scale 40 and an FTY scale 42, as well as three windows 44 (i.e. holes cut into the facesheet) which permit scales 24, 26, and 28 of sliding sheet 20 to be viewed when this sheet is inserted into the stationary pocket section 22, and another window 46 for the OpCount scale 30. Window 46 permits OpCount scale 30 to be aligned on either DPU scale 40 or FTY scale 42. Alongside the windows 44 are respective printed indicators 48 that are preferably mutually aligned arrows that point towards corresponding values on their respective scales. In addition, the facesheet 32 preferably includes printed material next to each of the scales 40 and 42 as well as windows 44 and 46 to guide the user as to the meaning of each scale. For example, the words "Defects per Unit" (or "DPU") can be printed above the DPU scale 40, "First Time Yield" (or "FTY") next to the FTY scale 42, and so on.

DPU scale 40, OpCount scale 30 and DPMO scale 24 are preferably logarithmic scales. The parameters DPU, OpCount and DPMO are related to each other through the linear relationship given by equation (1), so that if values for any two of these three parameters are known, the third can be calculated. The most commonly encountered situation is when DPU and OpCount are known. In this case, values for these parameters are selected with the DPU and OpCount scales 40 and 30 by aligning the two values with each other, and the corresponding value for DPMO is read off the DPMO scale 24 with its indicator 48. In the less commonly encountered situation in which values for DPMO and either DPU or OpCount are known, the DPMO value can be selected with the indicator 48 of the DPMO scale 24, and then the DPU (or OpCount) value can be found on its respective scale, with the value of the remaining parameter then being read off of its scale.

The parameters Sigma Rating and $C_{pk}$ are related to each other by equation (4), and to DPMO through the Gaussian function relationships discussed above. Since there is a one-to-one relationship between these parameters, a known value for one establishes the other two. The scales for DPMO 24, Sigma Rating 26 and $C_{pk}$ 28 are spatially aligned with respect to each other on the sliding sheet 20 so that their values under their respective indicators 48 reflect this one-to-one relationship.

DPU scale 40 and FTY scale 42, which are located on the facesheet 32, have a one-to-one relationship with each other given by equation (2). This fact is reflected in the relative positioning of DPU scale 40 and FTY scale 42, which are preferably located on opposite sides of window 46. The marks of OpCount scale 30 preferably extend across the full length of window 46, so that they can be used as a guide for the eye when making this correlation between the DPU and FTY scales 40 and 42. Thus, if values for FTY and OpCount are known, values for DPMO, Sigma Rating and $C_{pk}$ can be calculated. Preferable ranges for the scales of the parameters disclosed herein are: DPU ($1\times10^{-6}$ to 10), OpCount (1 to 10), FTY (99.9999% to 1%), DPMO ($10^{6}$ to 0.02), Sigma Rating (1.5 to 7.0), and $C_{pk}$ (0 to 1.85).

While a particular embodiment of the invention has been shown and described, numerous variations and alternate embodiments will occur to those skilled in the art. Accordingly, it is intended that the invention be limited only in terms of the appended claims.

I claim:

1. A slide rule for Six Sigma calculations, comprising:

a stationary scale display section;

a sliding scale display section that slides relative to said stationary section;

a Defects per Unit (DPU) scale displayed on one of said sections;

an Opportunity Count (OpCount) scale displayed on the other of said sections in alignment with said DPU scale; and a scale displayed on one of said sections for at least two parameters selected from the group consisting of Defects per Million Opportunities (DPMO), Sigma Rating and $C_{pk}$ that each measure how defect-free a product is, a statistical distribution of a specific characteristic of the product and its mean-shift over time being set to establish a one-to-one relationship between the parameters so that a single movement of said sliding section to align given DPU and OpCount values with each other calculates and displays the values for the selected parameters, the display of at least two said parameters increasing the amount of data available to a user and facilitating correlation of the different parameters.

2. The slide rule of claim 1, including scales for each of said DPMO, Sigma Rating and $C_{pk}$ parameters that are displayed so that corresponding values for each of said DPMO, Sigma Rating and $C_{pk}$ parameters are established from given aligned values of DPU and OpCount.

3. The slide rule of claim 1, in which said OpCount scale is displayed on said sliding section.

4. The slide rule of claim 1, in which said DPU and OpCount scales are both logarithmic.

5. The slide rule of claim 1, further comprising a First Time Yield (FTY) scale on the same section as and aligned with said DPU scale.

6. The slide rule of claim 5, wherein said OpCount scale is displayed on said sliding section, said stationary section includes a window for said OpCount scale, and said DPU and FTY scales are displayed on said stationary section along opposite sides of said window in alignment with each other.

7. The slide rule of claim 6, including scales for each of said DPMO, Sigma Rating and $C_{pk}$ parameters that are displayed on said sliding section in alignment with each other and with said OpCount scale, said stationary section including respective windows for viewing said DPMO, Sigma Rating and $C_{pk}$ scales.

8. The slide rule of claim 1, in which said DPU scale extends from about $1\times10^{-6}$ to about 10, and said OpCount scale extends from about 1 to about $10^6$.

9. A slide rule for Six Sigma calculations, comprising:

a stationary scale display section;

a sliding scale display section that slides relative to said stationary section;

a First Time Yield (FTY) scale displayed on one of said sections;

an Opportunity Count (OpCount) scale displayed on the other of said sections in alignment with said FTY scale; and a scale displayed on one of said sections for at least two parameters selected from the group consisting of Defects per Million Opportunities (DPMO), Sigma Rating and $C_{pk}$ that each measure how defect-free a product is, a statistical distribution of a specific characteristic of the product and its mean-shift over time being set to establish s one-to-one relationship between the parameters so that a single movement of said sliding section to align given FTY and OpCount values with each other calculates and displays the values for the selected parameters, the display of at least two said parameters increasing the amount of data available to a user and facilitating correlation of the different parameters.

10. The slide rule of claim 9, including scales for each of said DPMO, Sigma Rating and $C_{pk}$ parameters that are displayed so that corresponding values for each of said DPMO, Sigma Rating and $C_{pk}$ parameters are established from given aligned values of FTY and OpCount.

11. The slide rule of claim 9, in which said OpCount scale is displayed on said sliding section.

12. The slide rule of claim 9, in which said OpCount and DPMO scales are both logarithmic.

13. The slide rule of claim 9, in which said FTY scale extends from about 1% to about 99.9999%, and said OpCount scale extends from about 1 to about $10^6$.

14. A slide rule for Six Sigma calculations, comprising:

a stationary scale display section;

a sliding scale display section that slides relative to said stationary section;

a scale representing Opportunity Count (OpCount) displayed on one of said sections;

a plurality of scales representing at least two of a first set of Six Sigma parameters consisting of Defects per Million Opportunities (DPMO), Sigma Rating and $C_{pk}$ that each measure how defect-free a product is and are displayed on the same section as said OpCount scale; and at least one scale representing at least one of a second set of Six Sigma parameters consisting of Defects per Unit (DPU) and First Time Yield (FTY) displayed on the other of said sections, a statistical distribution of a specific characteristic of the product and its mean-shift over time being set to establish a one-to-one relationship between the parameters in said first set so that a single movement of said slide scale display to align said OpCount and second set parameter scales calculates and displays the values for the selected parameters in said first set, the display of at least two said parameters increasing the amount of data available to a user and facilitating correlation of the different parameters.

15. The slide rule of claim 14, in which said OpCount scale is displayed on said sliding section.

16. The slide rule of claim 15, including scales for each of said DPU and FTY parameters displayed on said stationary section, wherein said DPU and FTY scales are aligned with each other.

17. The slide rule of claim 16, said stationary section including a window for said OpCount scale, wherein said DPU and FTY scales are displayed along opposite sides of said window.

18. The slide rule of claim 14, including scales for each of said DPMO, Sigma Rating and $C_{pk}$ parameters.

19. The slide rule of claim 14, including logarithmic scales for each of said DPMO, DPU and OpCount parameters.

* * * * *